US010099901B2

(12) United States Patent
Peippo et al.

(10) Patent No.: US 10,099,901 B2
(45) Date of Patent: Oct. 16, 2018

(54) MAIN GIRDER OF CRANE

(71) Applicant: KONECRANES GLOBAL CORPORATION, Hyvinkää (FI)

(72) Inventors: Juha Peippo, Hyvinkää (FI); Niina Aikio, Vantaa (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 0 days.

(21) Appl. No.: 15/537,257

(22) PCT Filed: Dec. 16, 2015

(86) PCT No.: PCT/FI2015/050892
§ 371 (c)(1),
(2) Date: Jun. 16, 2017

(87) PCT Pub. No.: WO2016/097486
PCT Pub. Date: Jun. 23, 2016

(65) Prior Publication Data

US 2017/0349412 A1 Dec. 7, 2017

(30) Foreign Application Priority Data

Dec. 19, 2014 (FI) ..... 20146122

(51) Int. Cl.
*B66C 6/00* (2006.01)
*E04C 3/29* (2006.01)

(52) U.S. Cl.
CPC . *B66C 6/00* (2013.01); *E04C 3/29* (2013.01)

(58) Field of Classification Search
CPC ..... B66C 6/00; E04C 3/29
USPC .... 52/834, 836, 839, 841, 843, 309.4, 309.9
See application file for complete search history.

(56) References Cited

U.S. PATENT DOCUMENTS 2,731,824 A * 1/1956 Hadley ..... E01D 2/04 52/252
3,190,410 A * 6/1965 Molstad ..... B66C 7/00 52/843
3,271,917 A * 9/1966 Rubenstein ..... B29C 70/10 52/309.17
3,336,708 A * 8/1967 Rambelle ..... E04C 3/29 52/309.11
4,020,202 A * 4/1977 Kreft ..... B29C 69/003 428/33

(Continued)

FOREIGN PATENT DOCUMENTS

AT 502477 A4 4/2007
CN 103434930 A 12/2013

(Continued)

OTHER PUBLICATIONS

Extended European Search Report for Application No. 15869406.7, dated Jun. 26, 2018.

*Primary Examiner* — Brent W Herring
(74) *Attorney, Agent, or Firm* — Birch, Stewart, Kolasch & Birch, LLP

(57) ABSTRACT

A main girder of a crane for a crane trolley moving in a horizontal direction along the girder includes a cellular structure in a longitudinal direction thereof that has at least two separate, yet interconnected, longitudinal cellular elements, each cellular element including an outer cover structure and at least one outer cover structure having an inside filled with a core.

17 Claims, 2 Drawing Sheets

(56) References Cited

U.S. PATENT DOCUMENTS

| | | | | |
|---|---|---|---|---|
| 4,347,019 | A * | 8/1982 | Metz | E02D 5/30 405/255 |
| 4,795,666 | A | 1/1989 | Okada et al. | |
| 5,595,806 | A * | 1/1997 | Korfmacher | B65D 81/02 206/521 |
| 5,921,053 | A * | 7/1999 | Callahan | E04C 3/07 52/376 |
| 2012/0266561 | A1* | 10/2012 | Piedmont | E04C 3/28 52/834 |

FOREIGN PATENT DOCUMENTS

| | | | |
|---|---|---|---|
| CN | 203624834 | U | 6/2014 |
| DE | 2450595 | A1 | 4/1975 |
| DE | 29821061 | U1 | 6/1999 |
| EP | 0293789 | A1 | 12/1988 |
| FR | 1384434 | A | 1/1965 |
| FR | 2572788 | A1 | 5/1986 |
| JP | 58-95973 | U | 6/1983 |
| JP | 05338987 | A * | 12/1993 |
| JP | 6-92589 | A | 4/1994 |
| JP | 08119571 | A * | 5/1996 |
| JP | 2004-59161 | A | 2/2004 |
| KR | 10-0994414 | B1 | 11/2010 |
| SU | 718575 | A | 2/1980 |

* cited by examiner

MAIN GIRDER OF CRANE

BACKGROUND OF THE INVENTION

The invention relates to a main girder of a crane for a crane trolley moving in a horizontal direction along the girder, the main girder comprising a cellular structure in a longitudinal direction thereof that has at least two separate, yet interconnected, longitudinal cellular elements. On the top or bottom surface of the main girder in question there is or will be mounted as least one travel rail structure in a longitudinal direction of the main girder for the trolley.

Prior art main girders are typically beams that are made of relatively thick steel plates by welding or casing structures and have an upper plate, lower plate and one or more web plates between them. The travel rail structure is then preferably placed above the web plate so that local load caused by the trolley would be transferred to the web plate/plates.

To avoid web plate stability from being lost, the thickness of the plates used in the structure is increased and/or transverse and/or longitudinal reinforcements are added to the web until sufficient certainty against stability loss is obtained.

In these conventional solutions the number of parts is high and plenty of welding seams are used. The structure restricts minimizing of web plate thicknesses because then the number of reinforcements will be high. In some cases a conventional structure sets limits to utilization of strong steels.

SUMMARY OF THE INVENTION

It is an object of the invention to provide an improved main girder structure of crane, in which the above-mentioned problems are eliminated. This object is achieved by a main girder of the invention, which is characterized in that each cellular element comprises an outer cover structure and in that at least one outer cover structure has an inside filled with a core. Preferred embodiments of the invention are disclosed in the dependent claims.

The invention is based on an idea to form a main girder, preferably mainly entirely, as a modular structure by using in each case a required number of separate, yet interconnectable, cellular elements having a suitable shape and selectively filled with a core.

Because of the core, which may comprise foamed and/or solid material that may be e.g. glued or thermally attached, the cellular elements may comprise an outer cover structure formed of thinner material thickness than in the prior art. The foamed material may be plastic, such as polyurethane.

The invention enables very thin steel to be utilized in a beam-like structure in which one of the loads acting on it is a considerable concentrated crushing force. The invention enables a thin plate field to be made to function similarly as a thin plate field on a resilient base. It is thus possible to distribute a point load to more webs.

When implemented in this manner, the main girder of the invention will show increased stability against buckling and hence thinner material thicknesses than before may be made use of in the plate material of the main girder.

Other advantages that may be mentioned is a total mass reduction of as much as 30 to 40% in the structure, and the possibility to employ large-scale production methods in the manufacturing process of the main girder structure, which may reduce the required manufacturing time even to a quarter of what is needed when manufacturing a main girder with conventional methods. Moreover, no seams for fastening transverse intermediate plates, which reduce fatigue strength, are needed in the structure of the invention. Instead of acting on one web plate, a point load is now distributed among more than one web plates. This allows plate crushing to be prevented better than in existing structures.

LIST OF FIGURES

The invention is now described in closer detail by means of the preferred embodiments and with reference to the accompanying drawings, in which.

DETAILED DESCRIPTION OF THE INVENTION

Figure 1:
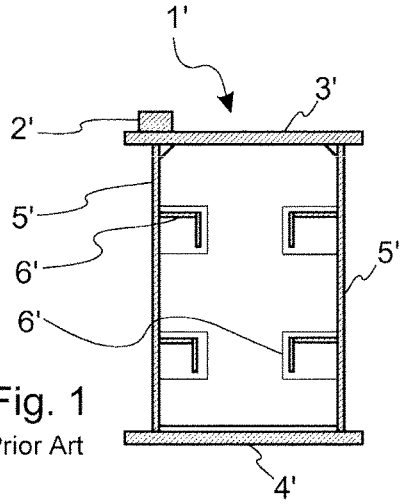
Fig. 1 Prior Art
FIG. 1 shows a cross section of a prior art main girder.

FIG. 1 shows a prior art main girder 1' of a crane for a crane trolley (not shown) moving in a horizontal direction along the girder, which has a travel rail structure 2' for the trolley fastened on the upper surface thereof, in a longitudinal direction of the main girder. The main girder 1' is formed of a horizontal top plate 3' and bottom plate 4' and web plates 5' welded between these and provided with longitudinal reinforcements 6' and intermediate plates that remain inside a casing structure thus formed. The travel rail structure 2' is mounted on an upper surface of the main girder 1', on one side thereof, for transferring vertical loads caused by the trolley to a web structure 5' in an optimal manner. The top and bottom plates 3' and 4' in particular are significantly thick and heavy. The reinforcements 6' have made it possible to reduce the thickness of the web plates 5' but, on the other hand, they also are one cause of increased robustness of the structure.

Figure 2:
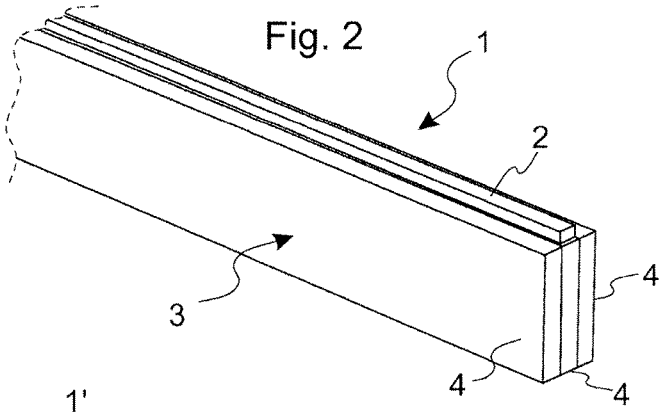
FIG. 2 is a perspective view of a main girder in accordance with the invention.
Figure 3:
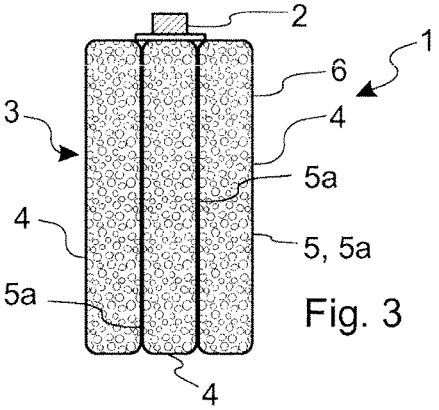
FIG. 3 shows a cross section of the main girder according to FIG. 2.

Next, a reference is made to FIGS. 2 and 3 which illustrate a solution according to the invention. The figures show a main girder 1 of a crane for a crane trolley (not shown) moving in a horizontal direction along the girder, which has a travel rail structure 2 for the trolley mounted on the upper surface thereof, in a longitudinal direction of the main girder. Here the main girder 1 comprises, in a longitudinal direction thereof, a cellular structure 3 with separate, yet interconnected, longitudinal cellular elements 4. The minimum number of the cellular elements 4 is two. In this example there are three parallel cellular elements 4 which are attached together in a sealed and rigid manner with longitudinal welding seams (not shown) at top and bottom seam positions.

In this example, the cellular elements 4 extend substantially on the entire length of the main girder 1, thus replacing the prior art casing structure altogether. The cellular elements 4 are rectangular and greater in height than in width.

Each cellular element 4 comprises an outer cover structure 5 and a core 6 of solid or foamed material that fills the inside of the outer cover structure 5. The foamed material may be polyurethane, for example, that adheres well to the inner surface of the outer cover structure 5. The outer cover structure 5 has vertical sides 5*a* that form the actual web structure, but the core 6 serves as an additional reinforcement and thus a considerably thin material may be used in the entire outer cover structure 5 in comparison with a prior art cover structure.

The travel rail structure 2 has been mounted immediately on top of the cellular structure 3, symmetrically in the middle of the main girder 1, and thus the load caused by the trolley travelling on the travel rail structure 2 is distributed to each vertical side 5*a* of the cellular structure 3, which form the web structure of the main girder 1 in question.

Figure 4:
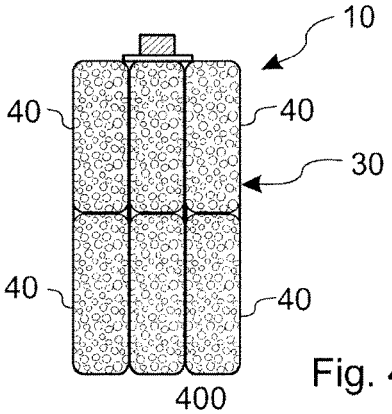
FIG. 4 shows a cross section of an alternative main girder of the invention.

In FIG. 4 the cellular structure 30 of the main girder 10 comprises parallel and superimposed cellular elements 40. There may also be more or less of the cellular elements 40 or a different number in different layers, in which case the web structures do not necessarily need to coincide. There are numerous alternatives implementing the invention. In this example all the cellular elements 40 are filled with a core 60.

Figure 5:
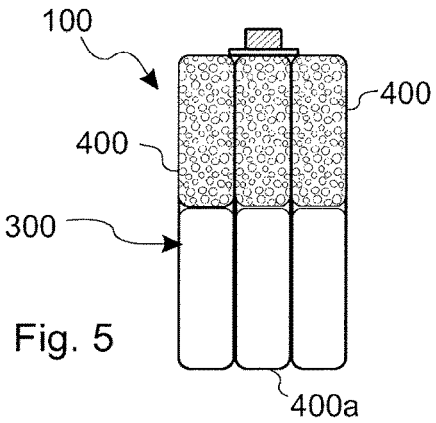
FIG. 5 shows a cross section of a second alternative main girder of the invention.

FIG. 5 shows a cellular structure 300 of a main girder 100 which is otherwise similar to the one in FIG. 4 except that only the uppermost cellular elements 400 have a core 600 while the lowermost cellular elements 400*a* are empty. If so desired, some of the cellular elements in any cellular structure of a main girder of the invention may be full, i.e. filled with a core, while others may be empty, i.e. without a core. The drawings illustrate some examples only.

Figure 6:
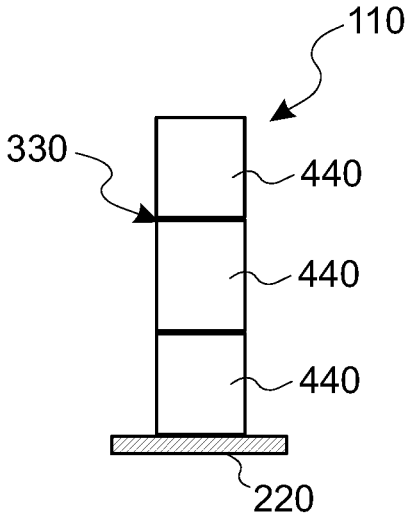
FIG. 6 shows a cross section of yet another alternative main girder of the invention.

FIG. 6 shows a cellular structure 330 of a main girder 110 with three superimposed cellular elements 440, one or more of which is also filled with a core (not shown). In this example the trolley is supported to the bottom surface of the main girder 110 and, for this purpose, the bottom surface of the cellular structure 330 is provided with a flange structure 220 in a longitudinal direction of the main girder 110 for the trolley.

In the cellular structures of the invention, the cellular elements may be of different heights or sizes, the upper and the lower cellular elements may have a "common" flange in the middle, and the cellular elements may be interconnected by an additional plate/plates although these implementations are not separately shown in the drawings.

Figure 7:
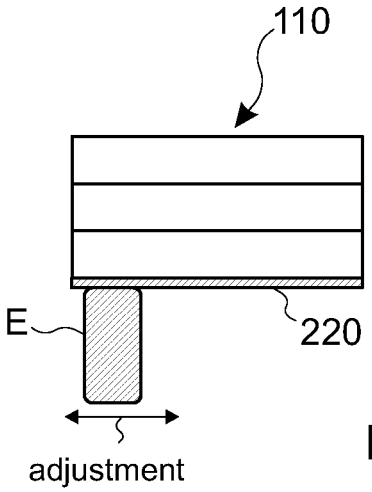
FIG. 7 shows supporting of the main girder according to FIG. 6 to an end support.

FIG. 7 shows how the positioning of the main girder 110 on an end support E may be adjusted in the structure of the invention, the structure of FIG. 6 being used here as an example, in the longitudinal direction of the main girder 110 without a risk of the structure buckling. In the prior art, the main girder is conventionally provided with transverse intermediate plates reinforcing the web at the support between the main girder and an end girder. In that case the point of support is determined already during the manufacture of the main girder. The present invention enables this restriction to be avoided.

The above description of the invention is only intended to illustrate the basic idea of the invention. A person skilled in the art may thus vary its details within the scope of the attached claims. Hence the number of the cellular elements, their shape and mutual positioning may vary as required and, therefore, the scope of the invention covers numerous other implementation alternatives in addition to the implementations disclosed here merely as examples.

The invention claimed is:

1. A main girder of a crane for a crane trolley consisting of:

a cellular structure having at least three separate, yet interconnected, longitudinal cellular elements, each cellular element consisting of:

an outer cover structure with vertical sides, the outer cover structure having an inner space; and a core filling the inner space; and a travel rail structure affixed to a top surface of the cellular structure, wherein the load caused by the travel rail structure is divided to more than two vertical sides of the cellular elements, and wherein the outer cover structure is exposed to the environment.

2. The main girder as claimed in claim 1, wherein the core comprises foamed material and/or solid material that may be glued or thermally attached.

3. The main girder as claimed in claim 2, wherein the foamed material is plastic.

4. The main girder as claimed in claim 3, wherein the plastic is polyurethane.

5. The main girder as claimed in claim 1, wherein at least the selected cellular elements extend substantially on the entire length of the main girder.

6. The main girder as claimed in claim 1, wherein each cellular element is greater in height than in width.

7. The main girder as claimed in claim 1, wherein the cellular structure comprises cellular elements having a substantially rectangular cross-section.

8. The main girder as claimed in claim 1, wherein the cellular structures are attached together in a sealed and rigid manner.

9. The main girder as claimed in claim 1, wherein the travel rail structure is mounted immediately on top of the cellular structure, symmetrically in the middle of the main girder.

10. The main girder as claimed in claim 1, wherein the travel rail structure is mounted immediately on top of the cellular structure, symmetrically in the middle of the main girder, and each cellular element has a substantially rectangular cross-section.

11. The main girder as claimed in claim 10, wherein the core comprises foamed material and/or solid material that may be glued or thermally attached.

12. The main girder as claimed in claim 11, wherein the foamed material is plastic.

13. The main girder as claimed in claim 12, wherein the plastic is polyurethane.

14. The main girder as claimed in claim 10, wherein at least the selected cellular elements extend substantially on the entire length of the main girder.

15. The main girder as claimed in claim 10, wherein each cellular element is greater in height than in width.

16. The main girder as claimed in claim 10, wherein the cellular structures are attached together in a sealed and rigid manner.

17. A main girder of a crane for a crane trolley comprising:

a cellular structure having at least six separate, yet interconnected, longitudinal cellular elements, each cellular element having an outer cover structure with vertical sides, each outer cover structure having an inner space, at least one outer cover structure having a core filling the inner space, and at least one outer cover structure not having a core filling the inner space, and a travel rail structure arranged on a top surface of the cellular structure, wherein the load caused by the travel rail structure is divided to more than two vertical sides of the cellular elements.

* * * * *